US006295697B1

(12) United States Patent
Simon

(10) Patent No.: US 6,295,697 B1
(45) Date of Patent: Oct. 2, 2001

(54) VANDAL-RESISTANT WALL-BUMPER

(75) Inventor: Martin S. Simon, Long Beach, CA (US)

(73) Assignee: Triangle Brass Manufacturing Co., Los Angeles, CA (US)

( * ) Notice: Subject to any disclaimer, the term of this patent is extended or adjusted under 35 U.S.C. 154(b) by 0 days.

(21) Appl. No.: 09/365,368

(22) Filed: Jul. 30, 1999

(51) Int. Cl.[7] ..... E05D 15/58
(52) U.S. Cl. ..... 16/86 R; 16/86 A; 16/86 B
(58) Field of Search ..... 16/86 R, 86 A, 16/86 B, DIG. 17

(56) References Cited

U.S. PATENT DOCUMENTS 1,345,469 * 10/1920 Daniele ..... 16/86 A
2,311,278 * 2/1943 Johnson ..... 16/86 R
3,484,891 * 12/1969 Borgen ..... 16/86 A
3,969,786 * 7/1976 Peak ..... 16/86 A

* cited by examiner

*Primary Examiner*—Chuck Y. Mah
*Assistant Examiner*—Enoch E Peavey

(57) ABSTRACT

A wall door stop includes a pin extending from the wall-facing surface. When installed on a wall exterior, the wall door stop may be attached by a regular or security screw to the wall. The pin engages a mating hole in the wall and inhibits unauthorized removal of the wall door stop through rotation and simultaneous pulling of the decorative ring. The pin engages the wall to prevent rotation of the decorative ring.

15 Claims, 2 Drawing Sheets

VANDAL-RESISTANT WALL-BUMPER

FIELD OF THE INVENTION

The present invention relates to a wall-mounted door-stop.

BACKGROUND OF THE INVENTION

Wall door-stops also called wall bumpers are an economical method to stop the swing of a door in order to protect both the wall behind the door and the door with its associated hardware. Wall bumpers are frequently favored by architects to eliminate the tripping hazard associated with a floor mounted stop as well. A wall bumper simply includes a compliant (i.e., rubber-like) bumper component that is attached to the wall where the door knob or lever would contact the wall in the bumper's absence. Its use prevents damage to the wall and/or the door knob. For aesthetic reasons, a metal ring is usually captured between the compliant bumper component and the wall.

The wall bumper is typically held in place with a single threaded attachment device such as a screw or anchor bolt, which is concealed upon installation within the compliant bumper component. This mechanism serves adequately as a permanent attachment for incidental wear and tear. Unfortunately, unauthorized removal of the attachment device is easily possible by grasping the decorative metal ring that surrounds the compliant bumper component, and rotating the metal ring counter-clockwise while pulling the metal ring away from the wall. For this reason, wall bumpers are not favored in schools, prisons, and other facilities that may be exposed to a hostile clinentèle prone to casual malicious mischief out of boredom or other nonconstructive motives. Consequently, such an economical device to prevent damage to walls from door handles has been precluded from use in such facilities without a mechanism to inhibit vandalism by deliberate removal of the wall bumper.

SUMMARY OF THE INVENTION

A wall door stop includes a pin extending from the wall-facing surface. When installed on a wall exterior, the wall door stop may be attached by a regular or security screw to the wall. The pin engages a mating hole in the wall and inhibits unauthorized removal of the wall door stop through rotation and simultaneous pulling of the decorative ring. The pin engages the wall to prevent rotation of the decorative ring.

DETAILED DESCRIPTION OF THE PREFERRED EMBODIMENTS

Those of ordinary skill in the art will realize that the following description of the present invention is illustrative only and not in any way limiting. Other embodiments of the invention will readily suggest themselves to such skilled persons after a perusal of the within disclosure.

The present invention is a device to obstruct removal of an installed wall-bumper. The "vandal-resistant" wall bumper incorporates a pin extending from the wall-facing surface of a frame such as a decorative ring of the bumper. This pin eliminates the ability of a mischievous person to simultaneously pull and rotate the decorative ring so as to thereby remove the wall bumper from the wall without authorization. The pin accomplishes this task in conjunction with the wall fastener by providing a structure sufficiently distant from the center of rotation so as to accept a much larger torsional moment between the wall bumper and the wall without appreciable movement.

Figure 1:
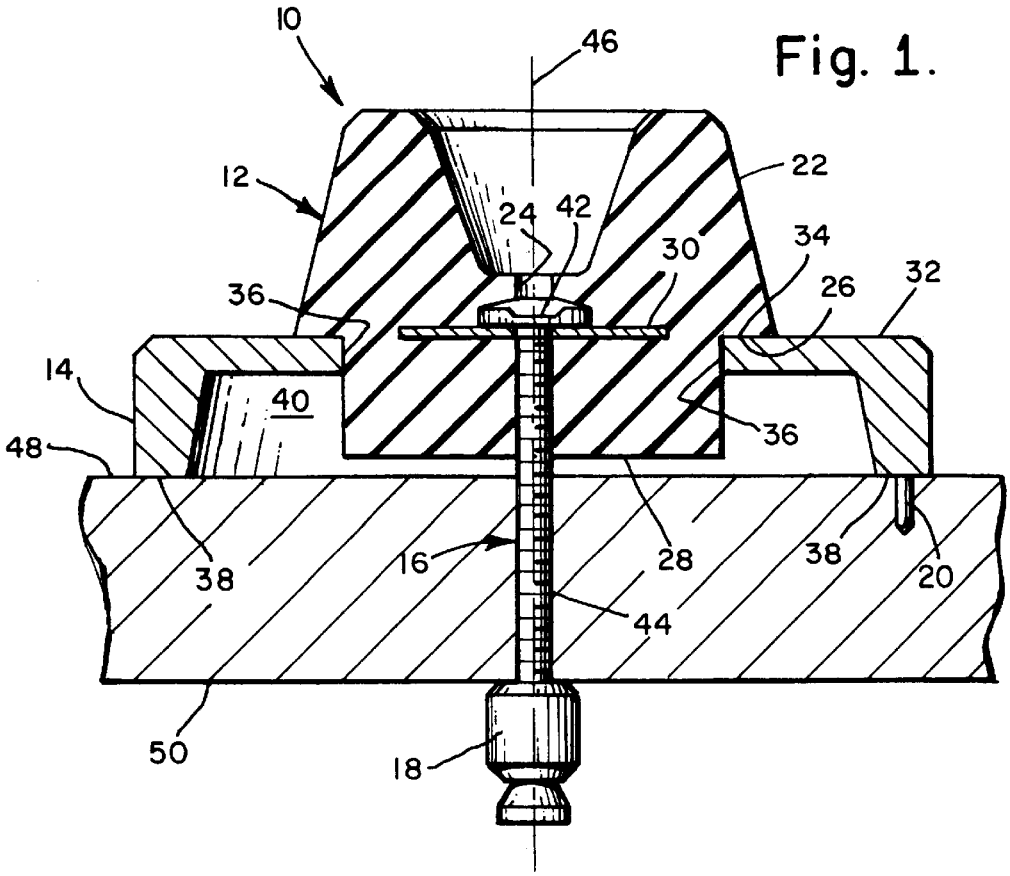
FIG. 1 is a cross-sectional side-view diagram of a wall bumper according to a presently preferred embodiment of the present invention.

A cross-sectional side-view of the present invention can be seen in FIG. 1. The wall bumper 10 preferably includes an impactable protrusion such as a compliant bumper component 12, a decorative ring 14, a wall fastener such as a threaded security screw 16 with a lead shield 18 when installed, and an underside pin 20 extending from the wall-facing surface of the decorative ring 14 to inhibit rotation. The compliant bumper component 12, composed primarily of an elastically deformable material such as rubber or an equivalent material, may have a rounded outer annulus 22 for receiving the compressive impact from a door handle slamming against it, a mesial aperture 24, an inner interface surface 26, a base plug 28, and a rigid washer 30. Such a compliant bumper component 12 as described features a concave shape. Alternatively, the compliant bumper component 12 may have an outer dome featuring a convex shape for receiving the compressive impact from a door handle. When prevention of unauthorized "thumb-turn" of the knob on the door handle is an objective, a concave shape for the compliant bumper component may be preferred. Otherwise, a convex shape may be selected.

The decorative ring 14, designed to protect the compliant bumper component 12 from shear and tensile deformation, has an outer surface 32 that is typically polished or painted and includes an outer interface surface 34, a ring opening with a radial interface surface 36, and a wall-facing surface 38 which faces the wall on which the wall bumper is attached. A cavity region 40 may also be included in the decorative ring 14 inside the wall-facing surface 38 as a weight-reduction measure.

The security screw 16 preferably comprises a head 42 and a threaded shaft 44. The security screw 16 is passed through the mesial aperture 24 of the compliant bumper component 12 through the axis centerline 46 of the wall bumper 10 and may be driven into the wall through a wall aperture by means of an installation tool applied to the head 42. As an additional security measure, the head 42 may be configured to apply torsional force in only one direction, such as clockwise for insertion into the wall aperture so as to preclude removal with a similar instrument to the installation tool. A security screw 16 is preferably inserted through the mesial aperture 24 of the compliant bumper component 12 and into a wall from the wall's outside surface 48 through an aperture in the wall. At the wall's interior surface 50 is preferably disposed a lead shield 18 or other type of conventional expansion anchor through which the security screw 16 is inserted into the wall aperture.

Alternatives to a security screw 16 with a lead shield 18 include use of an anchor bolt, a toggle bolt, a lag screw as well as other known fasteners. An anchor bolt has a sleeve which increases in diameter and decreases in length against the wall's interior surface 50 as the anchor bolt is turned clockwise. A toggle bolt has at least one pivotal flap that folds against the bolt shaft when inserted into the wall aperture, and pivots to present a profile larger than the wall aperture upon passing the wall's interior surface 50. A lag screw uses a lag shield that inserts into a wall to frictionally resist removal of the lag screw through the wall aperture. The wall-mounted door stop 10 may be sold or distributed separately from the security screw 16 or other attachment mechanisms. Other means of attaching a wall bumper to a shear resistant wall will also be readily apparent to those skilled in the art.

The mesial aperture 24 deformably expands to receive the mounting screw such as a security screw 16. The base plug 28 inserts into the ring opening while in contact with the radial interface surface 36. The rigid washer 30 inhibits lateral motion between the compliant bumper component 12 and the security screw 16. The compliant bumper component 12 restricts the movement of decorative ring 14 from moving away from the wall by the bumper's inner interface surface 26 and the ring's outer interface surface 34.

A pin 20 is rigidly disposed on the decorative ring 14 on the wall-facing surface 38 and, as shown in FIG. 1, may be independent of the compliant bumper component 12. The pin 20 is inserted into a hole in the wall that is created when the wall bumper 10 is installed on the wall outside surface 48. As the security screw 16 is turned clockwise along the axis centerline 46, the lead shield 18 is tightened against the wall's interior surface 50, inhibiting nontorsional motion of the wall bumper 10 in the direction of the axis centerline 46. When the wall bumper 10 is attached at the wall outside surface 48 by the security screw 16, the pin 20 seated in its corresponding hole in the wall prevents the decorative ring 14 from being rotated along the axis centerline 46. In the absence of the pin 20, a miscreant may simultaneously apply sufficient torque to the decorative ring 14 and tension to the security screw in order to retract the wall bumper 10 from the wall. With the pin 20 embedded within a wall, the torque necessary to shear off the pin 20 is quite high. Thus, the miscreant may be prevented from removing the wall bumper 10 without appropriate tools.

Figure 2:
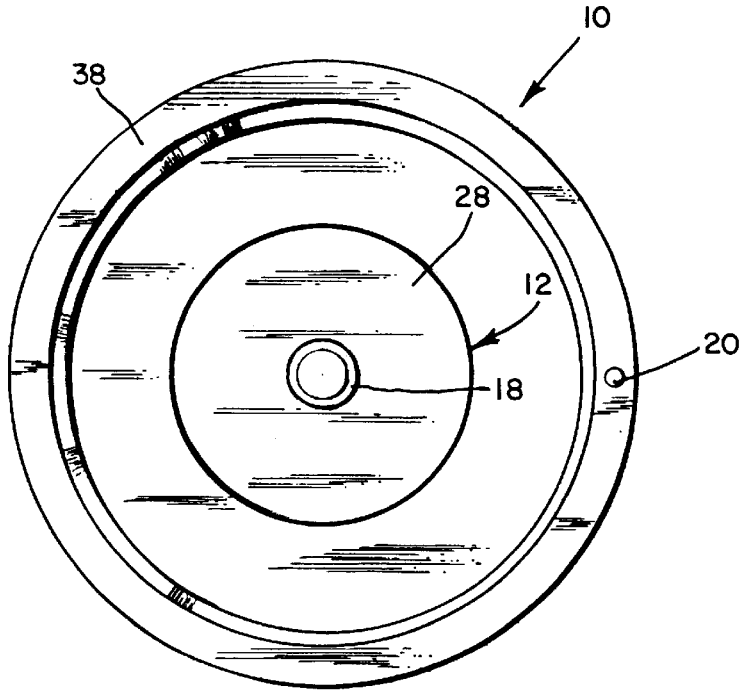
FIG. 2 is a bottom-view diagram of a wall bumper according to a presently preferred embodiment of the present invention.

A bottom view of the wall bumper is shown in FIG. 2, clearly showing the antirotational impediment for turning the decorative ring 14 when the pin 20, engaged in the wall hole, presents a moment-resistance far in excess of the torsional resistance presented by the security screw 16 alone. Additional resistance may be available with the use of additional pins 20 disposed on the wall-facing surface 38 of the decorative ring 14. While a pin 20 may appear at first to be a simple device for addressing the problem described above, a cost-effective solution has been unavailable until the present invention.

Figure 3A:
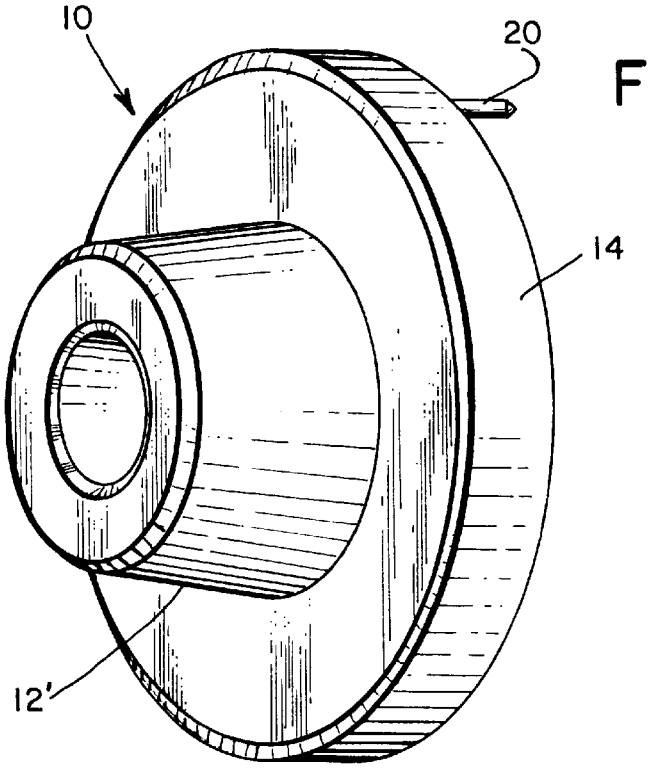
FIG. 3A is an isometric-view diagram of a wall bumper with an annular bumper component according to a presently preferred embodiment of the present invention.
Figure 3B:
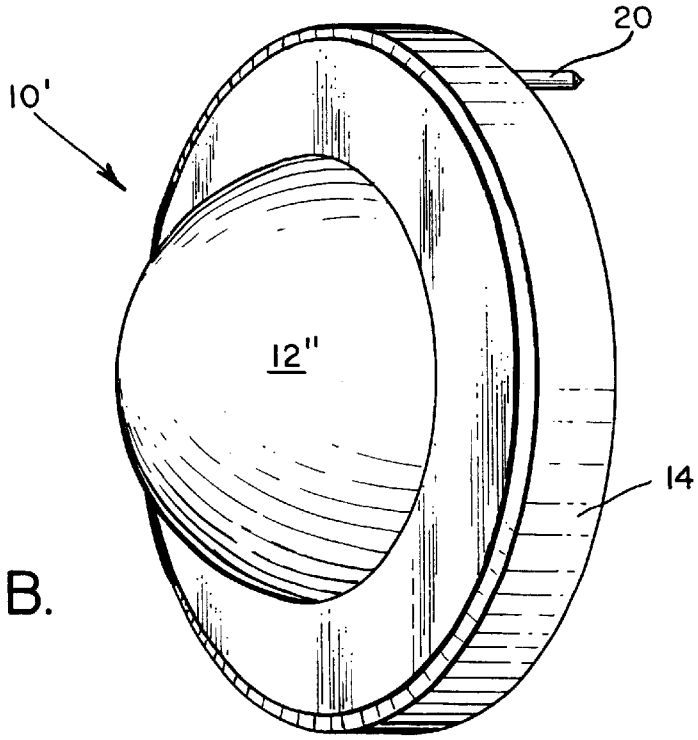
FIG. 3B is an isometric-view diagram of a wall bumper with a dome bumper component according to a presently preferred embodiment of the present invention.

Isometric views of the wall bumper according to the present invention may be seen in FIGS. 3A and 3B. The wall bumper 10 featuring the concave outer annulus as the compliant bumper component 12' is depicted in FIG. 3A. The wall bumper 10 featuring the convex outer dome as the compliant bumper component 12" is depicted in FIG. 3B. Other items of the wall bumper 10 are also featured in FIGS. 3A and 3B such as the decorative ring 14 and the pin 20 on the wall-facing surface of the decorative ring 14. Since the convex outer dome may lack an aperture to receive the wall fastener, the frame may as an alternative feature an aperture for this purpose to enable securing the wall bumper to the wall.

As manufactured, the pin 20 may be inserted during the production of the decorative ring 14, which may be formed by casting and polishing. A decorative ring 14 about 2¼ inches in diameter might employ a pin 20 extending beyond the wall-facing surface 38 by a length of 3/16 inch plus or minus 1/16 inch (alternately between ⅛ inch and ¼ inch) with a diameter of about 1/16 inch. Such dimensions enable a pin 20 to possess sufficient shear strength to resist unaided human-applied torsion and be sufficiently small to minimize packaging and installation complications.

While embodiments and applications of the invention have been shown and described, it would be apparent to those of ordinary skill in the art, after a perusal of the within disclosure, that many more modifications than mentioned above are possible without departing from the inventive concepts herein. The invention, therefore, is not to be restricted except in the spirit of the appended claims.

What is claimed is:

1. A wall-mounted door stop comprising:

a compliant bumper having an impactable protrusion, a base, and a mesial aperture disposed through said base to receive a fastener;

a frame having an opening for fitting said base and having a wall-facing surface; and at least one pin independent of said compliant bumper embedded in said frame extending substantially perpendicular from said wall-facing surface, said at least one pin adapted to be received into a hole in a wall.

2. A wall-mounted door stop according to claim 1 further including:

a fastener adapted to be received into said mesial aperture and insertable into a wall aperture.

3. A wall-mounted door stop according to claim 2 wherein said fastener is a threaded shaft attachment selected from the group consisting of security screw, anchor bolt, toggle bolt and lag screw.

4. A wall-mounted door stop according to claim 1 wherein said frame further comprises a decorative ring.

5. A wall-mounted door-stop according to claim 1 wherein said impactable protrusion for said compliant bumper further comprises an annulus.

6. A wall-mounted door stop according to claim 1 wherein said compliant bumper further includes a rigid washer disposed within, said rigid washer having an aperture disposed therethrough to receive a fastener.

7. A wall-mounted door stop according to claim 1 wherein said at least one pin is embedded into said wall-facing surface during a manufacturing process of said frame.

8. A wall-mounted door stop comprising:

a compliant bumper having an impactable protrusion and a base;

a frame having an opening for fitting said base, a wall-facing surface, and a mesial aperture disposed through said frame to receive a fastener; and at least one pin independent of said compliant bumper embedded in said frame extending substantially perpendicular from said wall-facing surface, said at least one pin adapted to be received into a hole in a wall.

9. A wall-mounted door stop according to claim 8 further including:

a fastener adapted to be received into said mesial aperture and insertable into a wall aperture.

10. A wall-mounted door stop according to claim 9 wherein said fastener is a threaded shaft attachment selected from the group consisting of security screw, anchor bolt, toggle bolt and lag screw.

11. A wall-mounted door stop according to claim 8 wherein said frame further comprises a decorative ring.

12. A wall-mounted door-stop according to claim 8 wherein said impactable protrusion for said compliant bumper further comprises a dome.

13. A wall-mounted door stop according to claim 8 wherein said at least one pin is embedded into said wall-facing surface during a manufacturing process of said frame.

14. A method to resist removal of a wall-mounted door stop fastened to a wall, said method comprising:

fitting a base of an impactable protrusion into an opening in a frame;

inserting a fastener through a mesial aperture in said impactable protrusion; and extending at least one pin substantially perpendicularly out of a wall-facing surface of said frame, said at least one pin being independent of said base and adapted to be received into a hole in the wall.

15. A method to resist removal of a wall-mounted door stop fastened to a wall, said method comprising:

inserting a fastener through a mesial aperture in a frame;

fitting a base of an impactable protrusion into an opening in said frame; and extending at least one pin substantially perpendicularly out of a wall-facing surface of said frame, said at least one pin being independent of said base and adapted to be received into a hole in the wall.

* * * * *